United States Patent [19]

Hauser

[11] 4,435,655

[45] Mar. 6, 1984

[54] LOG-CONFORMANCE ERROR CORRECTION CIRCUIT FOR SEMICONDUCTOR DEVICES

[75] Inventor: Max W. Hauser, Cambridge, Mass.

[73] Assignee: Tektronix, Inc., Beaverton, Oreg.

[21] Appl. No.: 264,366

[22] Filed: May 18, 1981

[51] Int. Cl.[3] ..... G06G 7/12

[52] U.S. Cl. ..... 307/490; 307/491; 328/145

[58] Field of Search ..... 307/490, 492, 491; 328/144, 145

[56] References Cited

U.S. PATENT DOCUMENTS

| | | | |
|---|---|---|---|
| 4,038,566 | 7/1977 | Evans | 328/145 |
| 4,156,283 | 5/1979 | Gilbert | 307/492 |
| 4,157,512 | 6/1979 | Schnioock | 307/491 |
| 4,308,471 | 12/1981 | Misawa | 307/492 |
| 4,353,000 | 10/1982 | Noda | 307/492 |

FOREIGN PATENT DOCUMENTS

| | | | |
|---|---|---|---|
| 36096 | 9/1983 | European Pat. Off. | 307/495 |

*Primary Examiner*—Stanley D. Miller
*Assistant Examiner*—B. P. Davis
*Attorney, Agent, or Firm*—George T. Noe

[57] ABSTRACT

A log-conformance correction circuit for a prototype circuit employing semiconductor devices comprises a quad of devices with voltage drops arranged in series, and currents or current densities driven such that the logarithmic components in the voltage drops sum to zero while log-conformance error components are produced. A correction quad suitably may comprise two pairs of semiconductor devices in which the current densities in one pair are cross-proportional with the current densities of the other pair, and of a different magnitude to establish a current density ratio between the pairs. The log-conformance error components which are generated by the correction quad are inserted into the prototype circuit to cancel log-conformance error therefrom.

4 Claims, 7 Drawing Figures

LOG-CONFORMANCE ERROR CORRECTION CIRCUIT FOR SEMICONDUCTOR DEVICES

BACKGROUND OF THE INVENTION

Certain semiconductor devices, such as bipolar junction transistors and diodes, among others, under active bias exhibit a voltage between one pair of terminals which is approximately proportional to the logarithm of the current flowing through another (or the same) pair of terminals. In addition to this logarithmic dependence, there is an additional voltage drop due primarily to resistive effects, and also to second-order effects within the semiconductor device. This additional component, or log-conformance error voltage, becomes especially significant when the devices are operated at relatively high current densities. The logarithmic dependence is exploited explicitly or implicitly in many analog-computational circuits, but the additional voltage causes errors. Prior art attempts to solve this problem have included limiting the operating currents for such circuits; however, this restricts signal range and is not a complete solution since the error is merely reduced rather than eliminated.

SUMMARY OF THE INVENTION

In accordance with the present invention, a log-conformance correction circuit is provided to correct log-conformance voltage errors, i.e., the deviation from the ideal logarithmic voltage-to-current relation predicted from basic device physics (e.g. the Ebers-Moll equations, in the case of bipolar transistors), caused by resistive mechanisms and other effects in practical semiconductor devices. The correction circuit comprises two pairs of semiconductor devices arranged in a quad in such a manner that the current densities in one of the pairs are cross-proportional with the current densities in the other pair and of a different magnitude to establish a current density ratio between the pairs. The correction quad samples the signal-dependent currents in a prototype circuit and generates a voltage which replicates the log-conformance error produced by such prototype circuit, but of opposite polarity. This replicated voltage is inserted into the prototype circuit, thereby canceling the log-conformance error therefrom.

The current density ratioing in the correction quad may be established by area scaling in the four devices while keeping the currents fixed, or by current scaling while keeping the areas fixed, or by a combination of both.

It is therefore one object of the present invention to provide a circuit for correcting log-conformance errors produced in semiconductor pn junctions and other semiconductor devices.

It is another object of the present invention to provide a correction circuit which corrects the effects of log-conformance error in analog circuits employing semiconductor devices.

It is a further object to provide a correction circuit which permits a prototype circuit to operate with substantially improved accuracy.

It is an additional object to provide a correction circuit which permits a prototype circuit to operate with a wide dynamic signal range.

It is yet another object to provide a correction circuit which may be incorporated directly into a prototype circuit.

It is yet an additional object to provide a correction circuit which is comparatively simple and inexpensive.

Other objects and attainments of the present invention will become apparent to those having ordinary skill in the art upon a reading of the following description when taken in conjunction with the accompanying drawings.

DETAILED DESCRIPTION OF THE INVENTION

Figure 1:
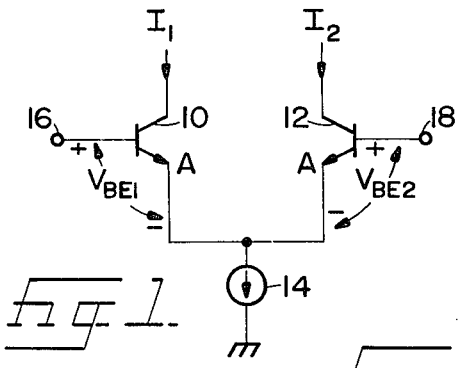
FIG. 1 is a schematic diagram of a circuit employed in explaining the present invention.

FIG. 1 ilustrates a pair of identical semiconductor devices operated differentially which will be preliminarily discussed to provide an understanding of the present invention. The devices are shown as a pair of transistors 10 and 12, the emitters of which are coupled together and connected to a source of current 14. Bias voltages are applied to the bases of transistors 10 and 12 through input terminals 16 and 18 respectively. When voltages $V_{BE1}$ and $V_{BE2}$ are developed across the base-emitter junctions of the respective transistors 10 and 12, currents $I_1$ and $I_2$ are produced at the respective collectors of the transistors, and the relationship between these voltages and currents may be ideally expressed as $$V_{BE1} - V_{BE2} = \left(\frac{kT}{q}\right) \ln\left(\frac{I_1}{I_2}\right), \quad (1)$$

where K is Boltzmann's constant, T is absolute temperature in degrees Kelvin, and q is equal to a charge on an electron. This relationship is exploited, explicitly or implicitly, in many analog circuits.

In actuality, error-producing mechanisms such as bulk resistances in the base and emitter regions, contact interfaces, metalization paths, etc., are inherent in these devices, and are not predicted in the basic relationship given above. Also, at high operating currents, additional error sources (current crowding, high-level injection, etc.) appear. The net result of these effects is an error voltage component in the base-emitter voltage, or $V_{BE}$, of each transistor. This error voltage is dependent on the respective collector current; since it occurs in each transistor, an error voltage term $V_E(I)$ must be added for each transistor in equation (1), yielding a more accurate expression $$V_{BE1} - V_{BE2} = \left(\frac{kT}{q}\right) \ln\left(\frac{I_1}{I_2}\right) + V_E(I_1) - V_E(I_2) \quad (2)$$

The error terms $V_E(I)$ are arbitrary functions of I and may suitably represent any deviation from the idealized expression (1) which has the form of a current-dependent error voltage present in $V_{BE}$. In practice, for bipolar junction transistors of typical construction, the error term $V_E(I)$ in the base-emitter voltage is observed to be a linear function of the collector current I (i.e., proportional to I) below a certain current level; above this current level, additional effects appear as noted above and the dependence of $V_E$ on I becomes nonlinear. The voltage $V_E(I)$ for each transistor will hereinafter be referred to as log-conformance error voltage. Since the effects giving rise to the $V_E$ error terms in equation (2) are dependent on current density in the vicinity of each base-emitter junction, it becomes apparent that different junction areas yield different magnitudes of log-conformance error, and that larger areas yield lower current densities, which in turn yield smaller $V_E$ terms. For the devices shown in FIG. 1, transistors 10 and 12 have identical base-emitter junction areas A. Equation (2) may be made more general by explicitly including the area dependences, giving $$V_{BE1} - V_{VE2} = \left(\frac{kT}{q}\right) \ln\left(\frac{J_1}{J_2}\right) + V'_E(J_1) - V'_E(J_2) \quad (3a)$$

$$= \left(\frac{kT}{q}\right) \ln\left(\frac{I_1}{I_2}\right) + V'_E(J_1) - V'_E(J_2) \quad (3b)$$

where $J_1 = I_1/A$, $J_2 = I_2/A$, and $V_E'$ represents log-conformance error voltage expressed in terms of current density, i.e., $V_E'(J) = V_E(AJ)$. A current density "J" will hereinafter denote the ratio of collector current to base-emitter junction area in a transistor. It is apparent from equations (3a) and (3b) that the logarithmic term may be expressed using either currents or current densities, since it depends on the ratio of either quantity, and these ratios are the same for equal-area junctions.

The previous remarks about the dependence of $V_E(I)$ on I also apply to the dependence of $V_E'(J)$ on J. In particular, $V_E'(J)$ tends to increase when J increases, so that smaller-area devices have a larger log-conformance error at a given current. Conversely, the magnitude of log-conformance error at a given collector current decreases as base-emitter junction area is made larger.

Figure 2:
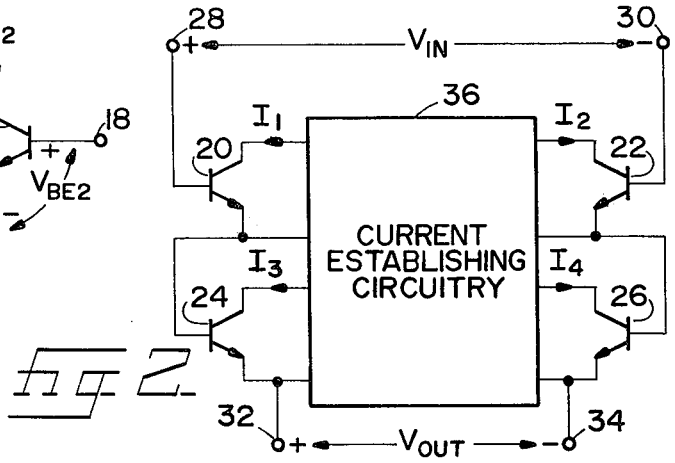
FIG. 2 is a schematic diagram of a log-conformance error correction circuit in accordance with the present invention.

Now, consider the circuit of FIG. 2. Four transistors 20, 22, 24, and 26 are arranged between a pair of input terminals 28 and 30 and a pair of output terminals 32 and 34. Auxiliary circuitry 36 for establishing the necessary currents $I_1$, $I_2$, $I_3$ and $I_4$ is connected to the transistors. Each pair of devices—the upper pair 20–22, and lower pair 24–26—obeys a current-voltage relation similar to the equations (1) through (3) developed above, including the log-conformance error.

Let us suppose for the moment that the lower devices 24 and 26 are constructed with a very large junction area so that current density J, and hence, the $V'_E$ terms for the lower pair, is substantially zero. Therefore, the ideal relation expressed by equation (1) holds for lower pair 24–26, while the upper pair 20–22 exhibits a log-conformance error. Now, if the junction currents are made cross-proportional for the two pairs, that is, $I_1/I_2 = I_4/I_3$, the logarithmic voltage components in the difference $V_{IN} - V_{OUT}$ will cancel out, leaving only the log-conformance error voltage $V'_E(J_1) - V'_E(J_2)$ from the upper pair 20-22. This isolated error voltage may be inserted, with suitable polarity, into another circuit employing a pair of junctions so as to cancel the log-conformance error from that other pair, provided $I_1$ and $I_2$ track the corresponding currents in that pair. Generally speaking, however, this proposed embodiment is impractical since the base-emitter junction area for the lower pair 24, 26 would have to be very large.

Finite-area devices may be used for the two pairs of semiconductor devices of FIG. 2 provided that the two pairs have cross-proportional current densities of different magnitudes, establishing a current density ratio for the upper versus the lower pairs. As long as this ratio is not unity, the logarithmic voltages from the two pairs will cancel but the log-conformance errors will not. Thus the lower pair, with finite-area devices, will have nonzero log-conformance error, but the error in the upper pair can be made somewhat larger to compensate, so that the difference $V_{IN} - V_{OUT}$ will again replicate the signal-dependent error in another pair and may be employed to cancel it. In practice, there are many possible ways to construct a correction quad of devices that satisfies these requirements, and it is applicable to correcting the errors of circuits far more complex than a simple pair of transistors.

Figure 3:
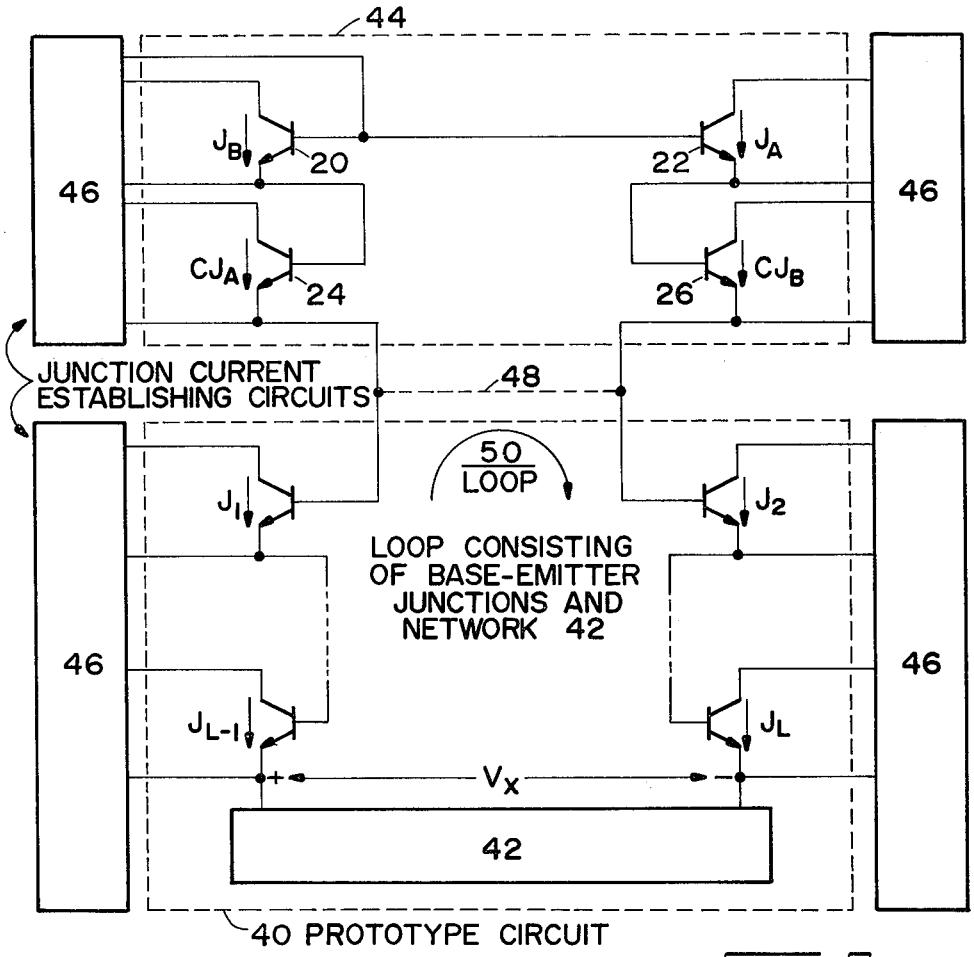
FIG. 3 is a schematic diagram showing the correction quad of FIG. 2 incorporated in a general prototype circuit.

Refer now to FIG. 3, which shows a general prototype circuit 40 that includes a series connection of some number L of base-emitter junction voltages in series with an arbitrary network 42, and a correction quad 44 comprising two pairs of transistors 20–22 and 24–26 connected thereto. Correction quad 44 has been added to prototype circuit 40 by breaking a connection 48 that would otherwise complete the top of prototype circuit 40. Loop 50 comprises the series connection of the quad 44, the L junctions in circuit 40, and the network 42. Current-establishing means 46 comprise tributary circuit paths to provide the various junction currents; however, such current-establishing means are well known in the art and therefore are not discussed in detail. The essential feature of prototype circuit 40 is the series connection to semiconductor junction voltages, each of which is subject to log-conformance error. The circuit 40 may contain many other features not shown, and may be part of a larger circuit containing other groups of series junction voltages. The circuit 40 may suitably represent any of a vast number of analog signal-manipulating circuits in which the logarithmic junction behavior is exploited to yield amplification, multiplication, division, exponentiation, or other linear or nonlinear operations. The input and output signals may be voltages in the loop or currents through one or more of the junctions. Examples will be given later. The network 42 with voltage $V_X$ represents the sum of voltage drops in the loop 50 from elements other than semiconductor junctions, and may represent an output or an input connection. If there are no such elements, $V_X = 0$.

The four devices of the correction quad 44 carry cross-proportional current densities and have a series connection of base-emitter junctions such that the logarithmic contributions in the voltage drops of these junctions sum to zero going around the loop. The current densities in the upper and lower pairs are related by a factor C to provide the necessary current density ratio. The values of $J_A$, $J_B$ and C may be derived from the current densities of the L original junctions in 40 in such a way that the log-conformance error components in the base-emitter voltages of transistors 20–26 will substantially or completely cancel the log-conformance error components of the base-emitter voltages within the prototype circuit 40. From Kirchoff's voltage law it is apparent that a suitable correction voltage inserted in series with the series-connected junction voltages of circuit 40 has the effect of correcting all of the individual log-conformance error voltages of the junctions in 40.

While in FIG. 3, the correction quad 44 is shown at one end of the loop, it should be apparent from Kirchoff's voltage law that the correction devices could theoretically be placed anywhere in the loop, so long as their orientation is preserved. Their only function is to add a signal-dependent correction voltage to the loop, and therefore, they could even be interspersed with the various junctions of the prototype cicuit to be corrected. With the cross-proportional current densities as shown in FIG. 3, the net voltage added to the loop by correction quad 44 is $$V'_E(J_A)+V'_E(CJ_B)-V'_E(CJ_A)-V'_E(J_B).$$

It is necessary to drive the devices 20–26 with current densities related to the signal-dependent current densities $J_1, J_2, \ldots, J_L$ of the prototype circuit 40. All required scaling (ratioing) of current densities, both within the quad 44 (by the factor C) and between the quad and the prototype circuit, may be accomplished by using identical currents while scaling the base-emitter junction areas, or the junction areas may be identical while the currents are scaled, or a combination of both. A junction area scaling may be obtained either by specific design of the transistors or by connecting various numbers of identical transistors in parallel to yield various equivalent junction areas.

In order to completely specify the correction circuit 44, to permit its complete design, it is necessary to specify a formula relating $J_A$ and $J_B$ to the parameter C and the signal-dependent current densities $J_1, \ldots, J_L$. A suitable relation is $$J_B - J_A = \left(\frac{1}{1-C}\right)\left(\sum_{\substack{cw\\n}} Jn - \sum_{\substack{ccw\\n}} Jn\right) \quad (4)$$

FIG.

for the junction orientations shown in FIG. 3, where $0<C<1$, and $$\sum_{\substack{cw\\n}} Jn, \quad \sum_{\substack{ccw\\n}} Jn$$

denote respectively the sums of current densities in transistors in circuit 40 with emitter arrows pointed clockwise and counterclockwise around the loop. The parameter C will be selected in advance according to design considerations (it permits a tradeoff between accuracy of correction at high currents and total area consumed) and equation (4) will then dictate how $J_A$ and $J_B$ should track the current densities $J_1, \ldots, J_L$ in the prototype circuit. Equation (4) presents one of various possible ways in which $J_A$ and $J_B$ may be determined as functions of C and $J_1, \ldots, J_L$. If equation (4) is satisfied, the correction quad will exactly cancel the sum of linear error components in the loop, thus exactly correcting so-called ohmic error, which is dominant at normal currents, and partially correcting additional non-linear effects such as base current "crowding". If the non-linear effects in the log-conformance error are known in detail, then an equation different from equation (4) may be derived if desired, so that $J_A$ and $J_B$ are determined in a way that minimizes some measure of net error in the complete circuit. Further, in the limit as C approaches 0 (e.g., the lower pair in a correction quad approaches an infinite area), the correction becomes exact for all log-conformance errors, both linear and nonlinear. Values of C greater than 1 imply a correction signal of the opposite polarity, which would enhance rather than cancel the errors.

Figure 4:
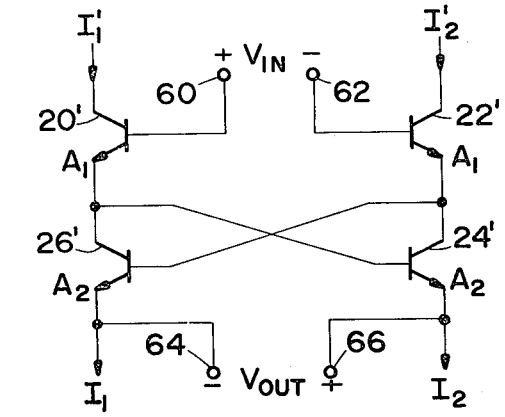
FIG. 4 is a schematic diagram of a practical correction quad embodiment for correcting log-conformance error in a prototype circuit in accordance with the present invention.

FIG. 4 shows a practical correction quad embodiment for correcting log-conformance error in some prototype circuit. The upper pair of semiconductor devices comprises transistors 20' and 22', the bases of which are connected to a pair of input terminals 60 and 62 respectively, across which an input signal $V_{IN}$ is applied. The lower pair of semiconductor devices comprises transistors 24' and 26' which are cross-coupled with transistors 20' and 22' in such a manner that the base of transistor 24' and the collector of transistor 26' are connected to the emitter of transistor 20', and the base of transistor 26' and the collector of transistor 24' are connected to the emitter of transistor 22'. Since the base-emitter junctions of transistors 20' and 24' are in series, as are the base-emitter junctions of transistors 22' and 26', and since the current paths for the currents $I_1$ and $I_2$ are respectively through transistors 20' and 26' on one side and transistors 22' and 24' on the other side, the desired cross-proportional current density for the correction quad is established. An output signal $V_{OUT}$ may be available at a pair of output terminals 64 and 66. As shown, the FIG. 4 embodiment provides a buffering effect in that the $V_{IN}$ signal source sees a high resistance at the bases of transistors 20' and 22', and the signal-dependent currents $I'_1$ and $I'_2$ do not flow through the signal source. On the other hand, however, there may be applications in which the signal dependent currents flow through the signal source, and accordingly, the bases of transistors 20' and 22' could be connected to their respective collectors to provide diode-connected transistors. If the current gains (betas) of transistors 20'–26' are high, then $I_1$ and $I_1'$ are nearly equal, as are $I_2 I_2'$, in of notation $C=A_1/A_2$, $J_A=I_2/A_1$, $J_B=I_1/A_1$.

In FIG. 4, the currents in the upper and lower pairs have (except for base current effects) the same magnitudes, so current density scaling must be accomplished by scaling junction areas. These areas may be selected from the relation set forth in equation (4) if exact cancellation of linear log-conformance error is desired. For example, suppose that the prototype circuit is a transistor pair with base-emitter junction area A as in FIG. 1, with the same respective currents $I_1$, $I_2$ as indicated in FIG. 4. With due regard for polarities, equation (4) yields $(I_1-I_2)/A_1=(1/(1-C))((I_1-I_2)/A)$, or $A_1=(1-C)A$. Since $A_1=CA_2$, the other area in the correction quad is then $A_2=((1-C)/C)A$. Thus, using the correction criterion (zero ohmic error) embodied in equation (4), the necessary areas have been expressed in terms of prototype device areas and the parameter C, which provides a degree of design freedom. Although C can range between 0 and 1, the designer may choose a specific value according to further considerations such as fabrication convenience and high-current error correction. For example, if $C=\frac{1}{2}$, then $A_1=\frac{1}{2}A$ and $A_2=A$.

Figure 5:
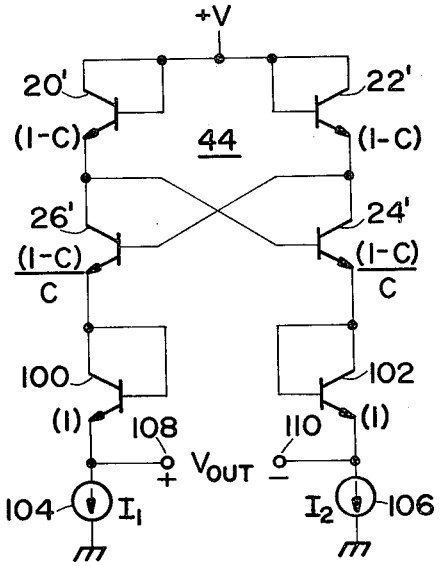
FIG. 5 is a schematic diagram of a simple log-ratio circuit incorporating a correction quad in accordance with the present invention.
Figure 6:
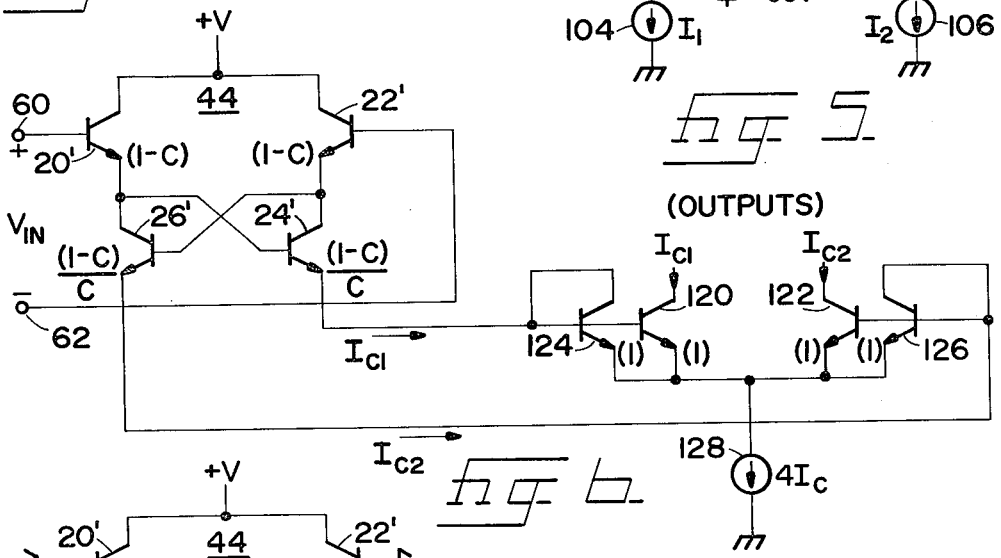
FIG. 6 is a schematic diagram of an inverse log-ratio circuit incorporating a correction quad in accordance with the present invention.
Figure 7:
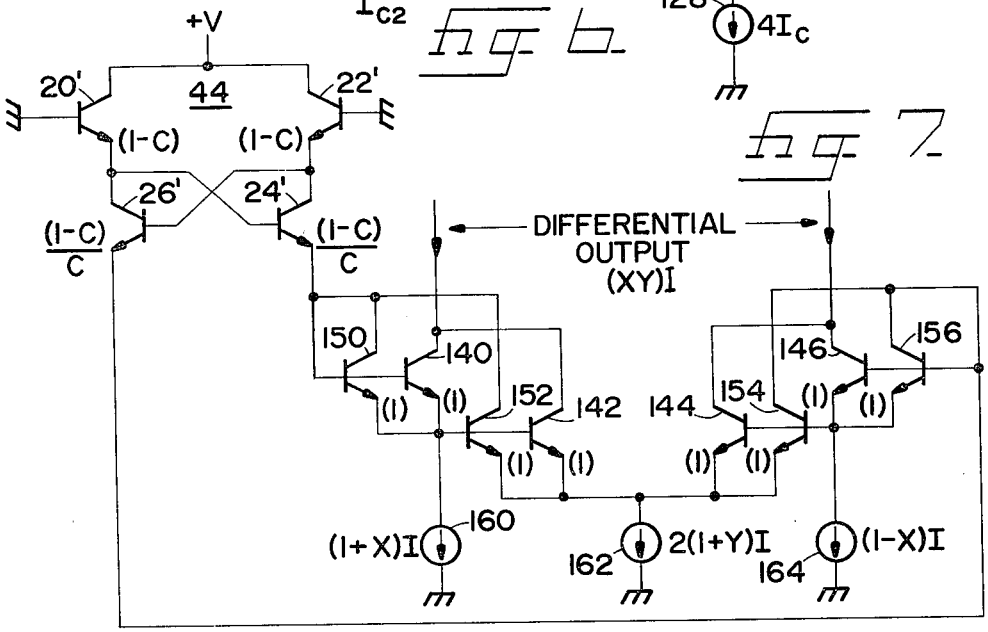
FIG. 7 is a schematic diagram of an analog multiplier incorporating a correction quad in accordance with the present invention.

FIGS. 5–7 illustrate examples of various analog circuits employing the log-conformance error correction technique of the present invention. For all of these examples, the relative junction areas of the devices are shown in parentheses next to the base-emitter junctions. FIG. 5 shows a simple log-ratio circuit comprising a pair of devices 100 and 102, the upper terminals of which are connected to the correction quad 44. The emitters of the devices 100 and 102 are connected to a pair of current sources 104 and 106 respectively, and also to a pair of output terminals 108 and 110 respectively. The ideal function of this circuit is $$V_{OUT}=\left(\frac{kT}{q}\right)\ln\left(\frac{I_2}{I_1}\right),$$

and the correction quad 44 permits this function to be realized with a high degree of accuracy. As mentioned previously the current density ratio factor C is a number between 0 and 1; however, the smaller the value of C chosen, the better the correction is of nonlinear log-conformance error, and the larger the total junction area required.

FIG. 6 shows an inverse log-ratio circuit comprising emitter-coupled transistors 120 and 122, which circuit is substantially corrected by the correction quad 44 to provide $$\frac{I_{C1}}{I_{C2}}=\exp\left(\frac{qV_{IN}}{kT}\right).$$

In this particular embodiment, the correction quad 44 is essentially the same as that shown in FIG. 4. Therefore, the input terminals 60 and 62 are shown connected to the bases of transistors 20' and 22' respectively. The sampled signal-dependent currents $I_{C1}$ and $I_{C2}$ flow through a pair of transistors 124 and 126 respectively. Transistors 124 and 126 are connected to the bases of transistors 120 and 122 respectively, which replicate the collector currents of transistors 124 and 126 to provide an output. A current source 128 is provided to establish the collector currents of transistors 120 through 126. A comparison of FIG. 6 with FIG. 5 illustrates how the same basic pair of transistors may be used for either logarithmic I-to-V or exponential V-to-I functions. The fundamental behavior of the transistor pair and of the correction quad 44 is the same in both examples; however, the topologies are different due to the different forms of input and output.

FIG. 7 shows a four-quadrant analog multiplier comprising transistors 140, 142, 144 and 146. The signal-dependent currents for the correction quad 44 are provided by transistors 150, 152, 154, and 156, each of which is connected to the base of a respective transistor in the four-quadrant multiplier. This example is a more complex practical embodiment of the generic circuit of FIG. 3, and illustrates that the correction quad 44 may correct the cumulative log-conformance error in more than one pair of critical junctions. The current sources 160, 162, and 164 establish the input currents in the circuit both to provide XY output and to provide the signal-dependent current for the correction quad 44.

This circuit, as well as the others described hereinabove, lends itself to practical realization in monolithic integrated-circuit form. Furthermore, the addition of the correction circuit allows the use of minimum-area transistors for the critical junctions, giving rise to higher-speed operation because of the reduced parasitic capacitances.

Throughout this description, bipolar transistors have been shown as the semiconductor devices. It should be apparent that the present invention can be applied to any devices which have a logarithmic voltage-current relationship with additive log-conformance error. Several known device types have this property, including pn and Schottky diodes, MOS field-effect transistors operated in the low-current (i.e., subthreshold) regime, and the recently developed permeable-base transistors. The correction circuit consists, in each case, of a quad of devices with voltage drops arranged in series, and currents or current densities driven such that the logarithmic components in the voltage drops sum to zero while the log-conformance error components do not.

While I have shown and described my correction technique both conceptually and be several practical embodiments, it will be apparent to those skilled in the art that many changes and modifications may be made without departing from my invention in its broader aspects. The appended claims therefore cover all such changes and modifications as fall therewithin.

What I claim as being novel is:

1. A circuit for correcting log-conformance error in a prototype circuit which includes semiconductor junctions, comprising:

a first pair of semiconductor devices; and a second pair of semiconductor devices operatively associated with said first pair of semiconductor devices such that the current densities of said second pair are cross-proportional with the current densities of said first pair and of a different magnitude;

wherein signal-dependent current derived from said prototype circuit flows through said first and second pairs of semiconductor devices and a correction voltage is generated thereby for correcting said log-conformance error.

2. A circuit in accordance with claim 1 wherein said first and second pairs of semiconductor devices include semiconductor junctions wherein, the respective junctions of said first pair are connected in series with respective junctions of said second pair.

3. A correction quad for correcting log-conformance error in a circuit employing semiconductor devices, comprising:

an upper pair of semiconductor junction devices through which signal-dependent current of said circuit flows; and a lower pair of semiconductor junction devices through which said signal-dependent current flows, respective ones of the lower pair of semiconductor junction devices being connected in series with respective ones of said upper pair of semiconductor junction devices, wherein the current densities of said lower pair are process-proportional with the current densities of said upper pair, and the magnitude of current densities of said lower pair differs from that of said upper pair by a predetermined ratio.

4. A correction quad in accordance with claim 3 wherein said semiconductor junction devices comprise transistors arranged in a loop such that logarithmic components in the base-to-emitter voltage drops sum to zero while a log-conformance error component is developed which is equal in amplitude and of opposite polarity to the log-conformance error produced by said circuit.

* * * * *

UNITED STATES PATENT AND TRADEMARK OFFICE

CERTIFICATE OF CORRECTION

PATENT NO. : 4,435,655

DATED : March 6, 1984

INVENTOR(S) : MAX W. HAUSER

It is certified that error appears in the above—identified patent and that said Letters Patent is hereby corrected as shown below:

Col. 5, line 21, "cicuit" should be --circuit--

Col. 6, line 49 should read -- $I_2$ and $I_2'$, and in terms of the notation in Fig. 3, $C=A_1$ --.

Signed and Sealed this

*Nineteenth* Day of *February 1985*

[SEAL]

*Attest:*

DONALD J. QUIGG

*Attesting Officer* *Acting Commissioner of Patents and Trademarks*